US010966538B2

(12) United States Patent
Tucker et al.

(10) Patent No.: US 10,966,538 B2
(45) Date of Patent: Apr. 6, 2021

(54) STUDIO SOFA WITH POWER HEADRESTS

(71) Applicant: HHG IPCO, LLC, New York, NY (US)

(72) Inventors: Beth Tucker, High Point, NC (US); Jeffrey Plunk, High Point, NC (US); Michael Riggs, High Point, NC (US)

(73) Assignee: HHG IPCO, LLC, New York, NY (US)

( * ) Notice: Subject to any disclaimer, the term of this patent is extended or adjusted under 35 U.S.C. 154(b) by 0 days.

(21) Appl. No.: 15/803,492

(22) Filed: Nov. 3, 2017

(65) Prior Publication Data

US 2018/0296001 A1 Oct. 18, 2018

Related U.S. Application Data

(60) Provisional application No. 62/486,730, filed on Apr. 18, 2017.

(51) Int. Cl.

| | |
|---|---|
| ***A47C 20/04*** | (2006.01) |
| ***A47C 17/12*** | (2006.01) |
| ***A47C 17/04*** | (2006.01) |

(52) U.S. Cl.
CPC ..... *A47C 20/041* (2013.01); *A47C 17/12* (2013.01); *A47C 17/04* (2013.01)

(58) Field of Classification Search
CPC ..... A47C 20/041; A47C 17/12; A47C 17/04
USPC ..... 297/1, 92, 105, 109, 118, 311, 445.1, 297/452.1
See application file for complete search history.

(56) References Cited

U.S. PATENT DOCUMENTS

| | | | | |
|---|---|---|---|---|
| 6,050,638 A * | 4/2000 | West, III | A47C 7/62 297/188.09 |
| 2014/0203608 A1* | 7/2014 | Phillips | A47C 1/0242 297/330 |
| 2015/0084386 A1* | 3/2015 | Hellman | A47C 4/54 297/188.08 |

* cited by examiner

*Primary Examiner* — Justin V Lewis
(74) *Attorney, Agent, or Firm* — Cook Alex Ltd.; R. Blake Johnston

(57) ABSTRACT

The studio couch of the subject invention is a seating unit having an end unit with a cushion which may be raised and lowered from a closed position to an open position.

9 Claims, 7 Drawing Sheets

STUDIO SOFA WITH POWER HEADRESTS

FIELD OF THE INVENTION

This invention relates to seating units and more particularly to seating units with power actuating headrests.

BACKGROUND OF THE INVENTION

Couches with backrests but no arms have become popular in recent times. However, when sitting or reclining in such a couch, one may desire an armrest or a headrest as an option.

BRIEF SUMMARY OF THE INVENTION

Accordingly, there is disclosed a studio couch having a power driven headrest or armrest at one or both ends of the couch wherein the armrest or headrest is raised from a horizontal position to a functional position with a power actuator. When the headrest or armrest of the subject invention is lowered from the functional position to the horizontal position and encounters an obstruction of some sort, the headrest or armrest automatically ceases movement until the obstruction is removed, at which time either gravity or a spring will close the unit. The storage position of the headrest or armrest may be within the couch or an attached ottoman.

The studio couch of the subject invention is a seating unit having an end unit with a cushion which may be raised and lowered from a closed position to an open position; The said end unit is supported by a frame, with a generally horizontally disposed cushion on the frame for movement between a closed position and an open position through a series of pivotally interconnected links. A power actuating unit is configured to reciprocally move the cushion from the closed position to the open position. The pivotally interconnected links comprise a first drive link and a second drive link, the first drive link being pivotal about a pin at a distal end thereof, and the second drive link being pivotal about the pin at a median point thereof, whereby the first drive link is connected for reciprocal movement to the power actuating unit. The first drive link drives the second drive link upward and thereby drives the cushion upward. A pair of stop pins can be used to limit the movement of the first drive link. The second drive link can have a slotted arm at a distal end. A bracket may be secured to the cushion, with a downward depending flange; the flange has a plurality of pins captured by a slot in the slotted arm for travel within, whereby movement of the second drive link causes movement of the cushion. The cushion is generally moved laterally while being pivoted in a vertical movement by first, second and third lift rods, the first lift rod connected at an end to said second drive link and at an opposing end to a midsection of the second lift rod; the second lift rod being pivotally connected at one end to the third lift rod; the third lift rod being connected to the slotted arm for pivotal movement, whereby the reciprocal movement of the second drive arm, through the respective connections of the first, second and third lift rods, reciprocally laterally moves the slotted arm while the slotted arm is simultaneously pivoting in a vertical movement.

In another aspect of the studio couch of the subject invention, there is a seating unit having an end unit which may be raised and lowered from a closed position to an open position, with the end unit supported by a frame. A generally horizontally disposed cushion is supported by the frame for movement between a closed position and an open position through a series of pivotally interconnected links. A power actuating unit reciprocally moves the cushion from the closed position to the open position. The pivotally interconnected links includes a first drive link connected to a second drive link for following movement. The second drive link has a notch for engagement with a pin on said first drive link, whereby upon contact with an obstruction in a downward movement of the seating unit, the pin is disengaged from the notch and the second drive link will cease the following movement.

BRIEF DESCRIPTION OF THE SEVERAL VIEWS OF THE DRAWING

FIG. 8(*b*) is a plan view of a second embodiment of the linkage of the subject invention.

DETAILED DESCRIPTION OF THE INVENTION

Figure 1:
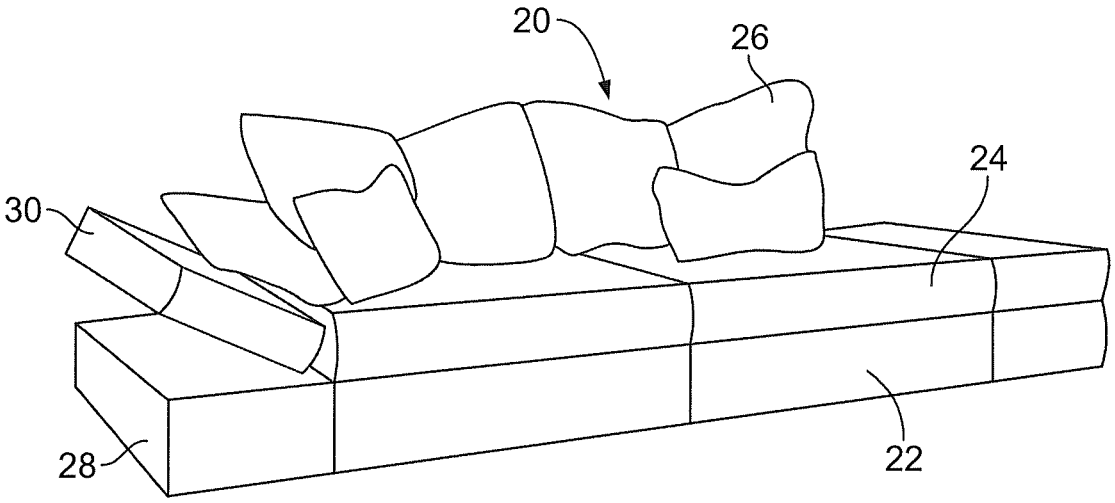
FIG. 1 is a perspective view of a studio couch of the subject invention.

Referring now to the figures, the seating unit may take the forms of a studio couch 20 as shown in FIG. 1. The studio couch 20 has a base unit 22, with the seat 24 generally disposed horizontally above the base unit 22 with a cushion resting on the base unit, and a backrest 26, much as a standard couch or sofa. On one or both ends of the base unit may be a storage unit 28 directly adjacent the base unit 22 and generally integral with the base unit 22. Supported by the storage unit is a cushion 30. The cushion 30 has a rigid framework 32 for a base so that it may be pivotally moved as a unit from a horizontal, closed position (FIG. 2), to a raised, open position (FIG. 3).

The headrest can include a power unit 50 for moving the headrest from a horizontal position to an upright position. Alternatively, the movement may be occasioned by purely manual means or by a spring, as known in the art. If a power unit is utilized, it has a retractable rod 56 that is attached at one end to a stationary mounting bracket 54, and at an opposing end to a cross member 52 that in turn is fixed to first drive link 60. The retractable rod 56 is driven by power unit 50 in reciprocal fashion to move cross member 52 and first drive link 60 accordingly.

Attached to the framework is a linkage system for moving the cushion 30 from a horizontal position to an upright functional position. In the linkage system, the driving link and subsequent connecting links are each on opposing sides of the base unit and as such, the opposing side is identical with identical movement and function as the facing side linkage; thus only one such assembly will be described.

Figure 4:
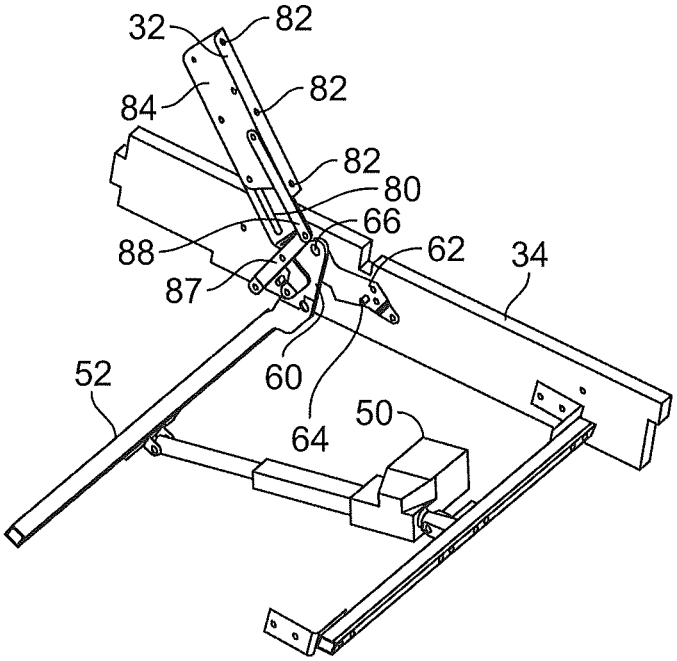
FIG. 4 is a perspective view of one side of the linkage of the subject invention in the open position.
Figure 5:
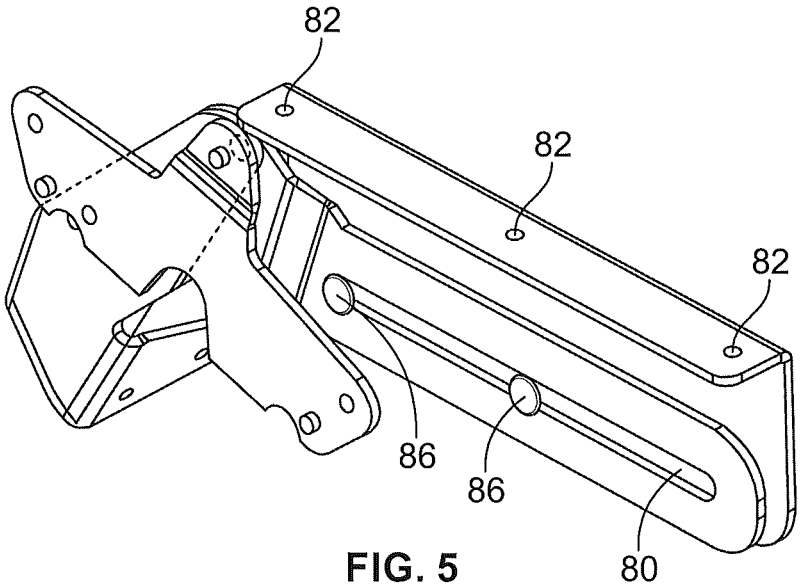
FIG. 5 is a perspective view of one side of the linkage of the subject in the closed position.
Figure 7:
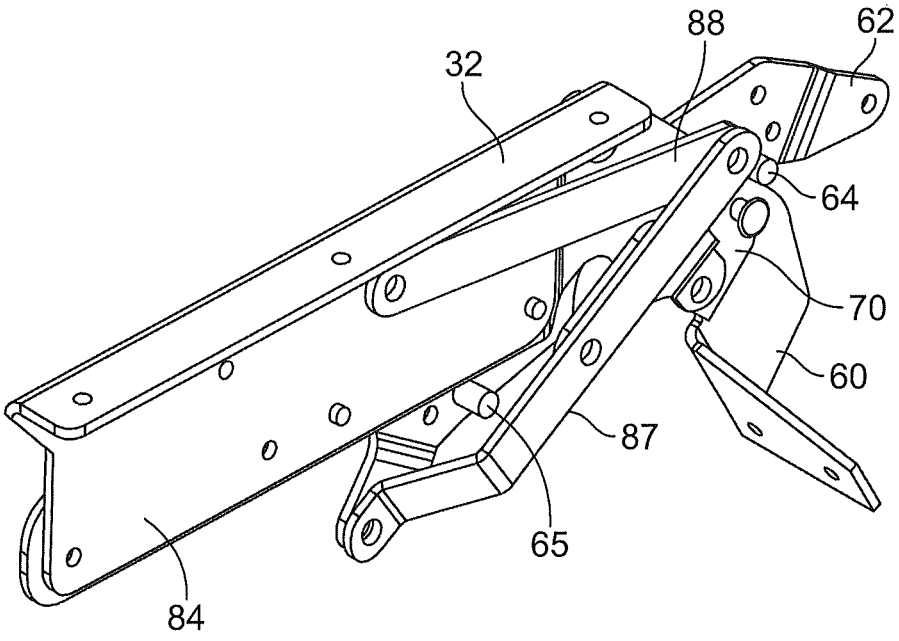
FIG. 7 is a front perspective view of the linkage of the subject invention.
Figure 6:
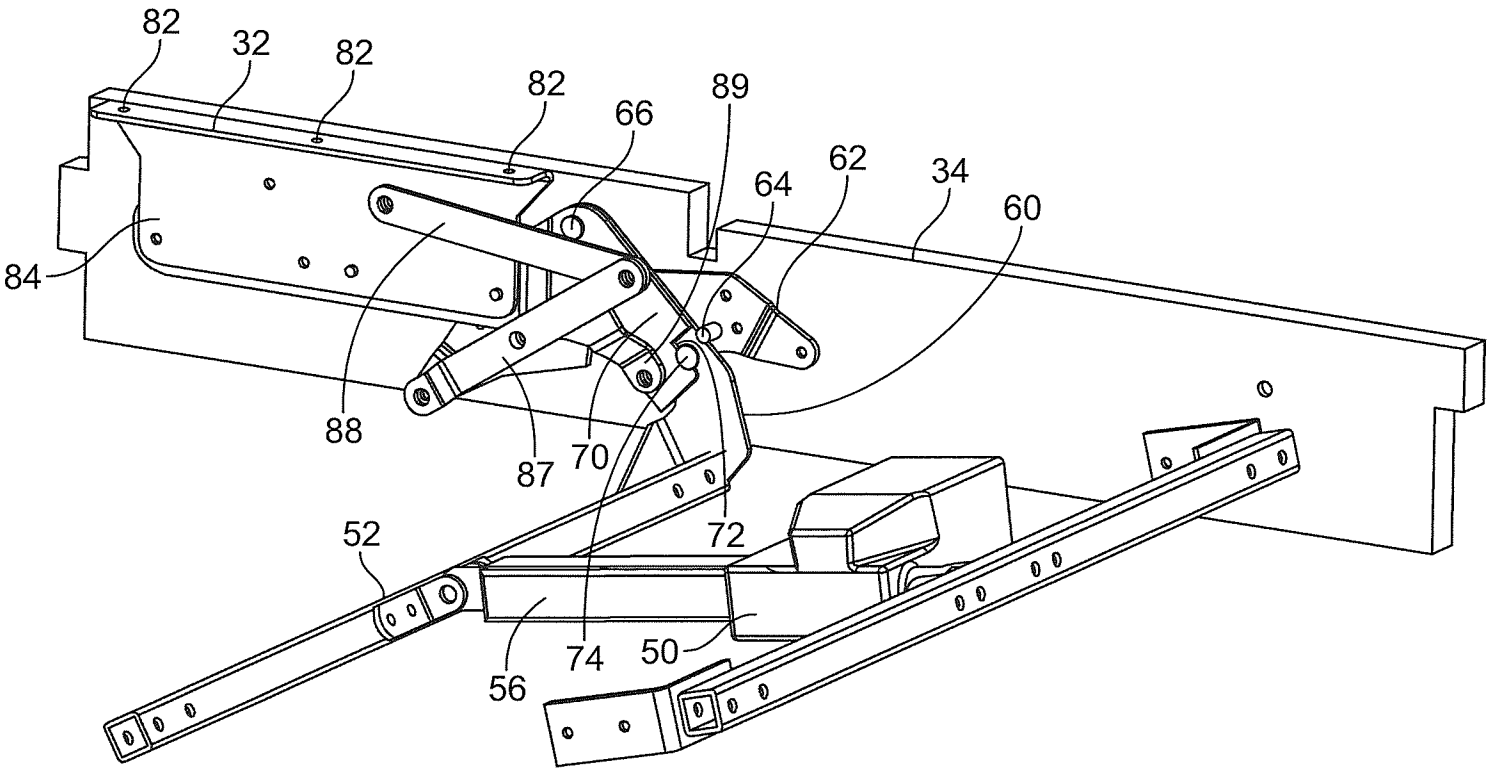
FIG. 6 is rear perspective view of the linkage of the subject invention showing the motor unit.
Figure 9:
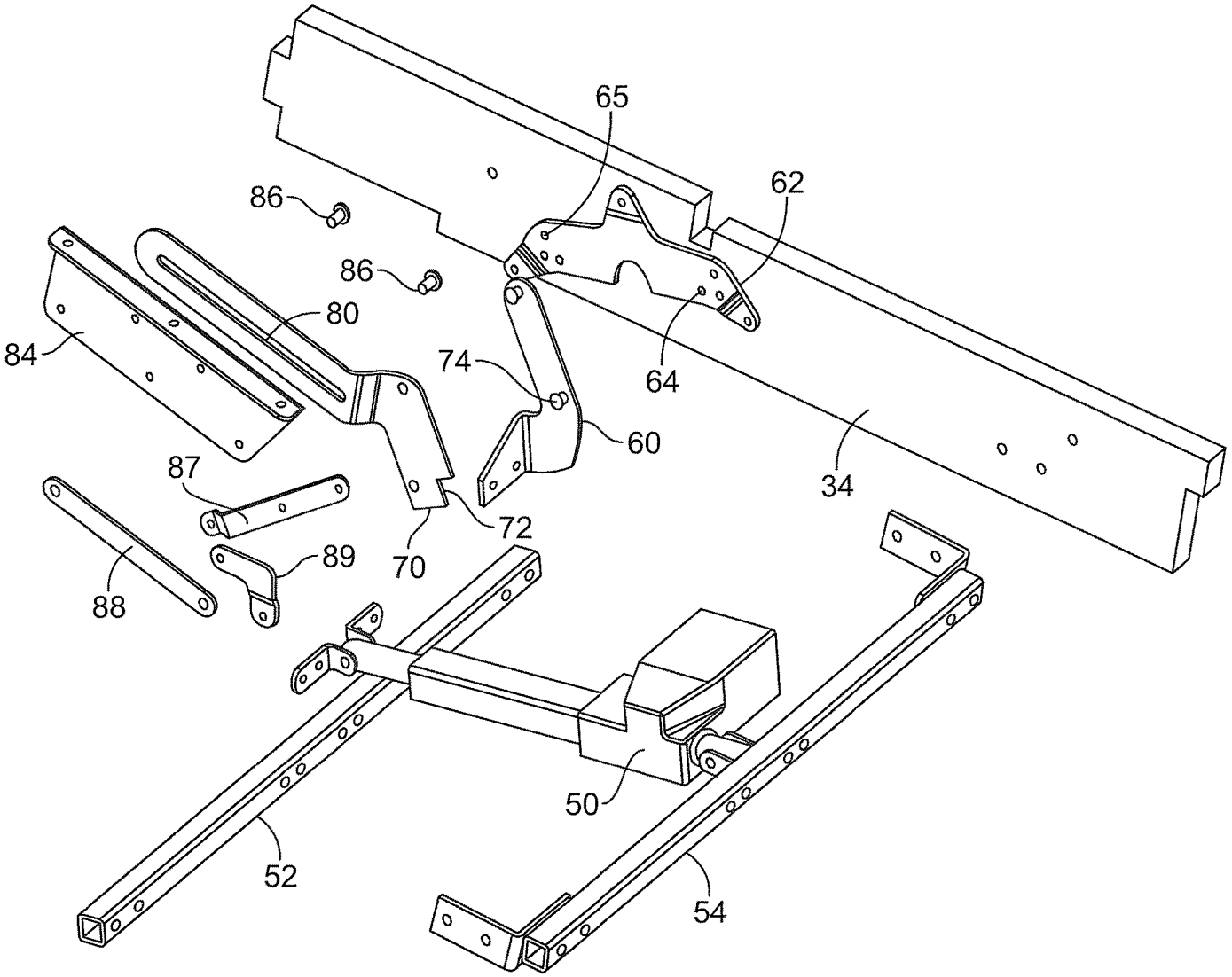
FIG. 9 is an exploded view of the linkage of the subject invention.

As shown in FIGS. 4 and 6, a mounting bracket 62 is secured to the framework 34 of the couch and has two stop pegs 64, 65 at either end (FIG. 9). At an end of the drive link 60 opposite the cross drive element 52 is a pivot pin 66 which pivotally secures the drive link 60 to the framework 34. Drive link 70 is also pivotally secured and supported at pivot pin 66, with the drive link 60 sandwiched between the drive link 70 and the mounting bracket 62. Drive link 70 has a notch 72 (best seen in FIG. 9), which will accept pin 74 on drive link 60 and serves to arrest the movement of drive link 70 in one direction when contact of the pin 74 is made with notch 72.

Figure 2:
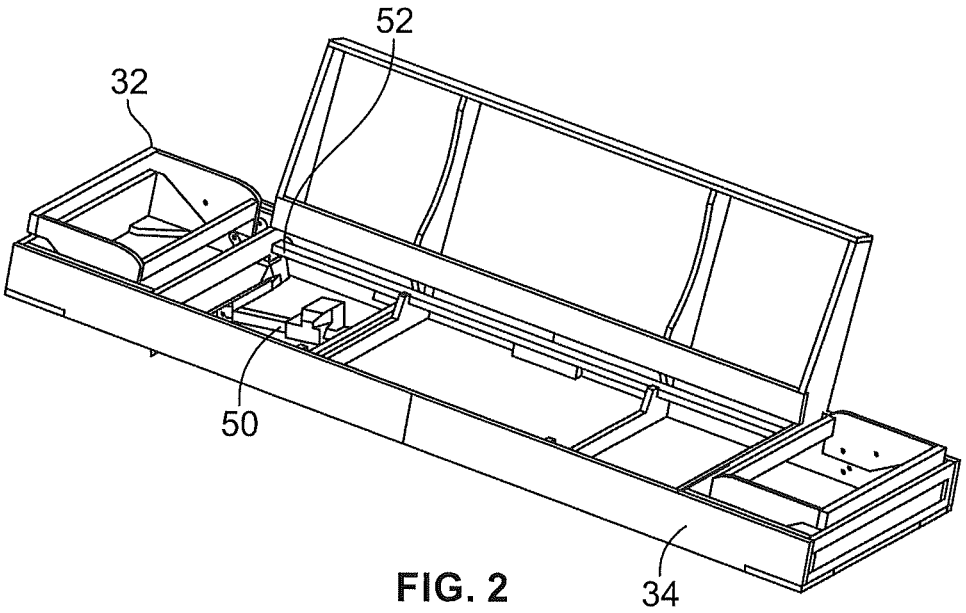
FIG. 2 is a perspective view of the studio couch framework of the subject invention in the closed position.
Figure 3:
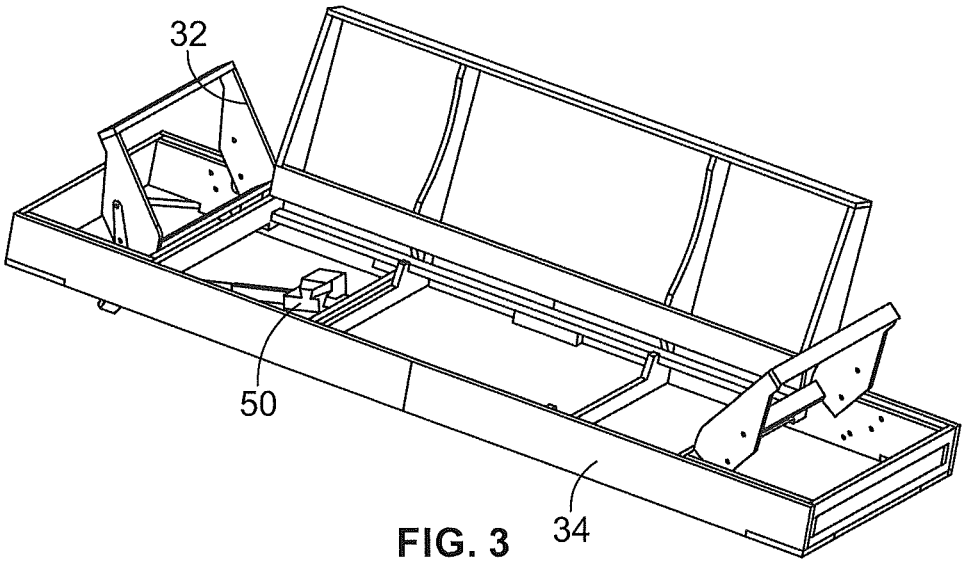
FIG. 3 is a perspective view of the studio couch framework of the subject invention in the open position.

Thus, the framework 32 and the cushion supported thereon can move from the position of FIG. 2 (closed) with the drive link 60 and drive link 70 substantially and generally diagonally aligned, as shown in FIG. 6 and the peg 74 within slot 72 to the position of FIG. 3 where the cushion support 32 is substantially in the vertical position and open. In this position the drive link 60 and the drive link 70 remain aligned. The final position is shown in FIG. 4, where the cushion support is in the vertical position, the drive link 60 is substantially vertical, and the drive link 70 aligned with drive link 60 in a generally vertical position.

For the above movement to occur, the motor unit 50 moves the cross member 52 and the drive link 60 which pushes the drive link 70 so that the pin 74 is against the notch 72. The motor unit 50 continues until a limit switch (not shown) trips at a certain specified stroke distance, as known in the art. If an obstruction such as a leg or arm occurs and impedes the travel of the cushion support/cushion base unit when closing, another limit switch (not shown) will trip and stop operation of the motor unit 50 and thus movement of the linkage assembly downward.

Figure 8A:
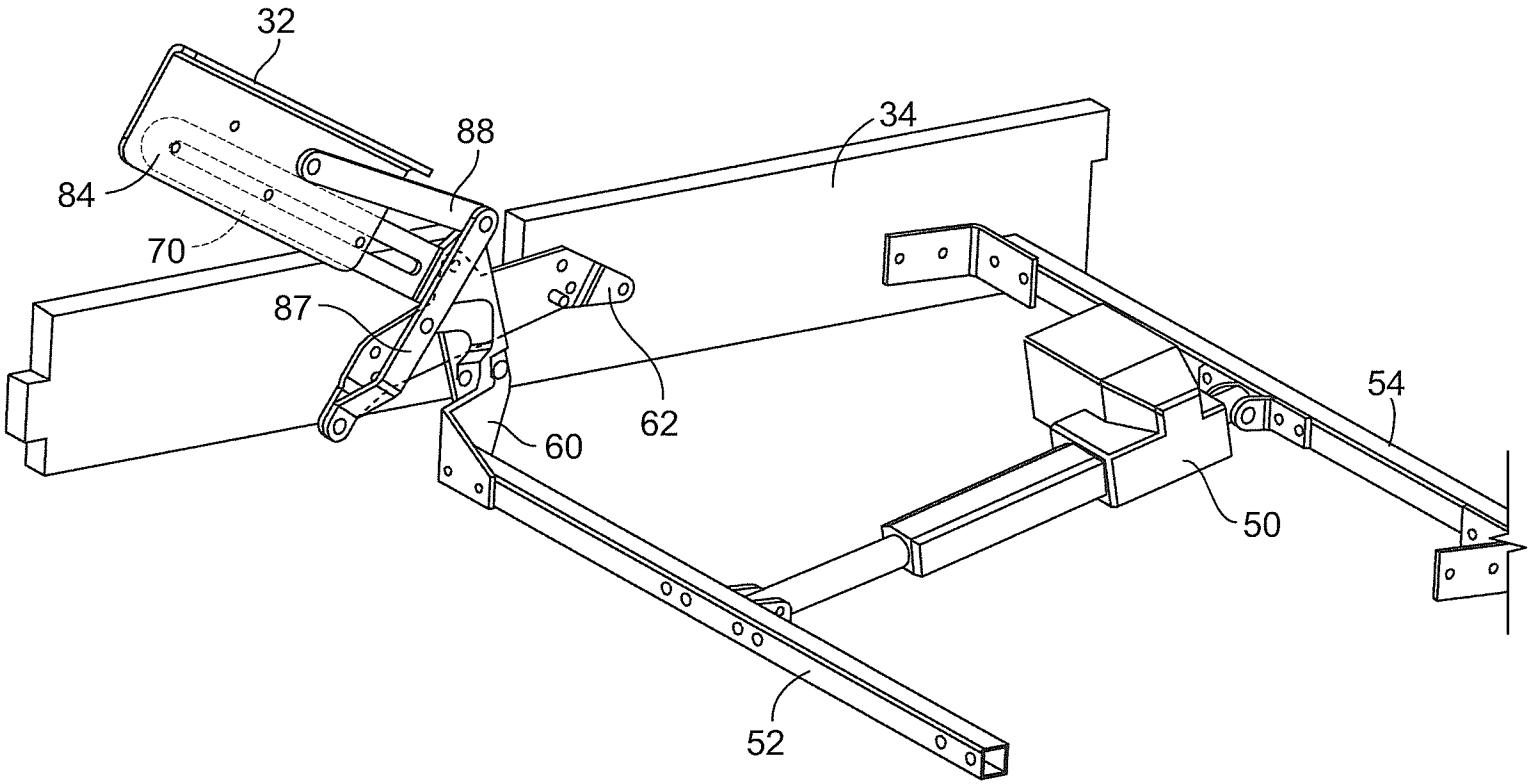
FIG. 8(*a*) is a plan view of one embodiment of the linkage of the subject invention, showing the slotted track in phantom.
Figure 8B:
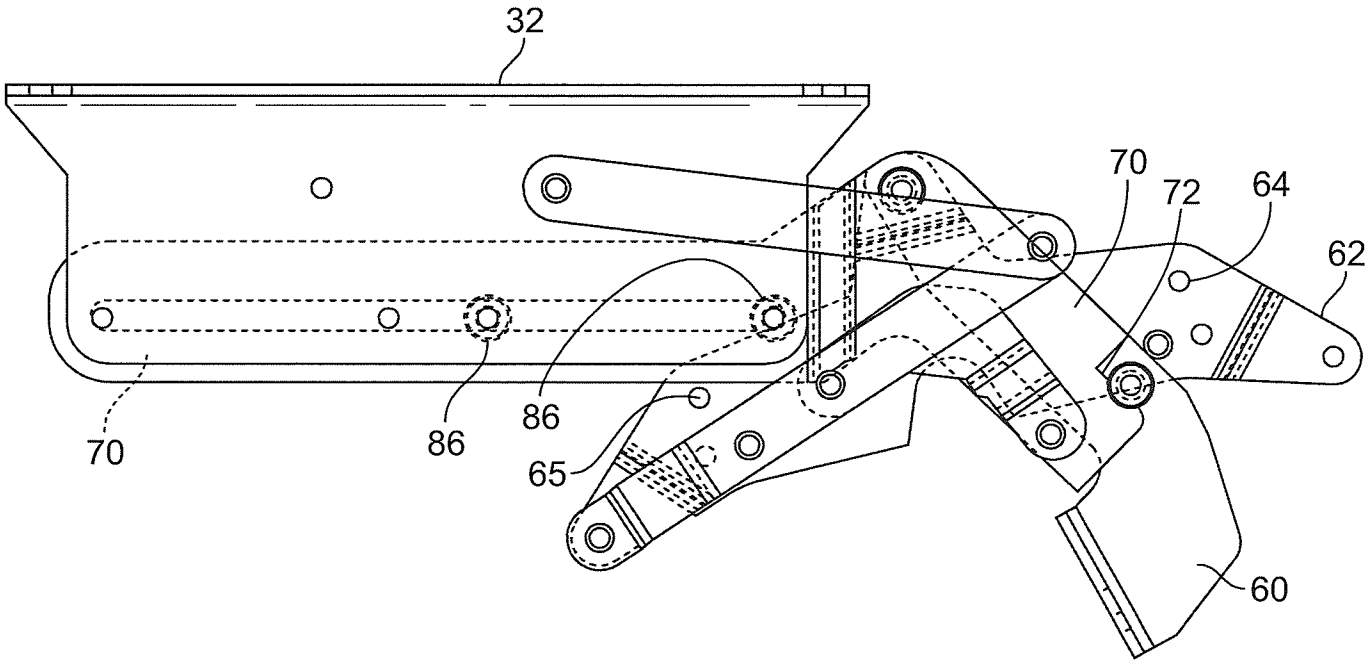

When the cushion 30 is pivotally moved upward, the motion is not as though the cushion is on a hinge. Rather, the cushion 30 is moved upward and outward as it pivots upward. It does this with a slotted track 80 to which the cushion 30 is attached. Bracket 84 is secured to the cushion by fasteners through openings 82 and carries the slotted track 80 through pins 86 which ride in the track 80 for longitudinal movement therealong (FIGS. 8 and 9). Slotted track 80 is integral with drive link 70, as may be seen in FIG. 9.

As shown in FIGS. 8(*a*) and 8(*b*), drive link 70 can be either above the mounting bracket 84 (FIG. 8(*a*)) or partially below the mounting bracket 84 (FIG. 8(*b*)). When above the mounting bracket the fabric cover of the cushion is less likely to catch on or drag on the linkage assembly than with the embodiment of FIG. 8(*b*).

Thus as the motor unit 50 drives rod 56 forward and thus cross member 52, the drive link 60 pushes the drive link 70 with the slotted track pivotally upward from the closed position of FIGS. 6 and 8, lift rods 87 and 88 force the bracket 84 forward while it pivots upward (FIGS. 4 and 6). Thus the attached cushion is pushed upward and out, away from the adjoining cushion on the main part of the sofa. In the open position both drive links are generally vertical and movement of drive links 60 and 70 are arrested by contact with stop pin 65.

The movement of the cushion laterally while pivoting upward is accomplished in the following manner:

A first lift rod 89 is V-shaped and connected at an end to the second drive link 70 and at an opposing end to a midsection of the second lift rod 87; the second lift rod 87 is pivotally connected at one end to the third lift rod 88; the third lift rod 88 is connected to the cushion support 32 for pivotal movement, whereby the reciprocal movement of the second drive arm 70, through the respective connections of the first, second and third lift rods, reciprocally laterally moves the slotted arm while the slotted arm portion 80 of the second drive link 70 is simultaneously pivoting in a vertical movement. Thus the slotted arm 80 pivots the cushion upward while the first, second and third lift rods move the cushion laterally.

In the closing operation, the motor unit 50 retracts the drive link 60 to a closed position as shown in FIGS. 6 and 8, where the drive link 60 is against stop pin 64 and the drive link 70 is substantially vertically aligned with drive link 60 in a diagonal position.

Should an obstruction, such as an arm or leg, get in the way of the closing operation, the movement of the cushion will stop, and then, once the obstruction is removed, the closing operation, may continue. When an obstruction is encountered, pin 74 slips out of contact with notch 72, and continues face down in the cushioned causes second drive arm 70 to disengage with drive link 60 and allow drive link 60 to move without driving the second drive arm 70. Thus there is no more movement of the cushion downward. Thus second drive 70 is pivotally connected to first drive link for following movement. When pin 74 disengages from notch 72, the second drive link 70 ceases its following movement with the first drive link and movement of the cushion stops.

A spring or other elastic object may be attached to an end of drive link 70 to bring the cushion to a closed position after the obstruction is removed. In the alternative, gravity may be relied upon to close the cushion.

It will be understood that the foregoing description is of preferred exemplary embodiments of the invention and that the invention is not limited to the specific forms shown or described herein. Various modifications may be made in the design, arrangement, and type of elements disclosed herein, as well as the steps of making and using the invention without departing from the scope of the invention as expressed in the appended claims.

The invention claimed is:

1. A seating unit having an end unit which may be raised and lowered from a closed position to an open position comprising:

a base having a seat positioned thereon;

said end unit being supported by a frame;

a cushion supported by said frame for movement relative to the seat between a closed position, where the cushion is horizontally disposed and positioned adjacent to the seat, and an open position through a series of pivotally interconnected links;

a power actuating unit configured to reciprocally move the cushion from the closed position to the open position;

wherein the pivotally interconnected links comprise a first drive link and a second drive link, the first drive link being pivotal about a pin at a distal end thereof, and the second drive link being pivotal about the pin at a median point thereof, whereby the first drive link is connected for reciprocal movement to the power actuating unit;

the first drive link driving the second drive link upward and thereby driving the cushion upward.

2. The seating unit of claim 1 further including a pair of stop pins for limiting the movement of the first drive link.

3. The seating unit of claim 1 wherein the second drive link has a slotted arm at a distal end thereof.

4. The seating unit of claim 3 further including a bracket secured to the cushion, the bracket having a downward depending flange, the flange having a plurality of pins captured by a slot in the slotted arm for travel within, whereby movement of the second drive link causes movement of the cushion.

5. The seating unit of claim 1 wherein the second drive link has a slot for engaging a pin to arrest a movement of the second drive link.

6. The seating unit of claim 5 wherein the slot loses engagement with the pin when an obstruction to movement downward of the end unit is encountered wherein the movement of the seating unit stops.

7. The seating unit of claim 1 wherein the seat has a front end, a back end opposing the front end and a pair of opposing side ends and further comprising a back rest secured to the back end of the seat and wherein said cushion pivots relative to the seat about an axis that remains parallel to the pair of opposing side ends of the seat as the cushion moves between the closed position and the open position.

8. A seating unit having an end unit which may be raised and lowered from a closed position to an open position comprising:

a base having a seat positioned thereon;

said end unit being supported by a frame;

a cushion supported by said frame for movement relative to the seat between a closed position, where the cushion is horizontally disposed and positioned adjacent to the seat, and an open position through a series of pivotally interconnected links;

a power actuating unit configured to reciprocally move the cushion from the closed position to the open position;

a means for moving the cushion laterally while pivoting the cushion in a vertical movement comprising first, second and third lift rods, the first lift rod connected at an end to said second drive link and at an opposing end to a midsection of the second lift rod; the second lift rod being pivotally connected at one end to the third lift rod; the third lift rod being connected to the slotted arm for pivotal movement, whereby the reciprocal movement of the second drive arm, through the respective connections of the first, second and third lift rods, reciprocally laterally moves the slotted arm while the slotted arm is simultaneously pivoting in a vertical movement.

9. A seating unit having an end unit which may be raised and lowered from a closed position to an open position;

said end unit being supported by a frame;

a cushion supported by said frame for movement between a closed position, where the cushion is horizontally disposed, and an open position through a series of pivotally interconnected links;

a power actuating unit configured to reciprocally move the cushion from the closed position to the open position, said series of pivotally interconnected links, including a first drive link connected to a second drive link for following movement;

said second drive link having a notch for engagement with a pin on said first drive link, whereby upon contact with an obstruction in a downward movement of the seating unit, the pin is disengaged from the notch and the second drive link will cease the following movement.

* * * * *